United States Patent [19]

Hingst

[11] Patent Number: 4,993,230

[45] Date of Patent: Feb. 19, 1991

[54] COOLING APPARATUS UTILIZING THE JOULE-THOMSON EFFECT

[76] Inventor: Uwe Hingst, Rebenstrasse 18, 7991 Oberteuringen, Fed. Rep. of Germany

[21] Appl. No.: 447,648

[22] Filed: Dec. 8, 1989

[30] Foreign Application Priority Data

Dec. 10, 1988 [DE] Fed. Rep. of Germany ..... 3841635

[51] Int. Cl.[5] ..... F25B 21/02

[52] U.S. Cl. ..... 67/512; 62/3.2

[58] Field of Search ..... 62/3.2, 51.2

[56] References Cited

U.S. PATENT DOCUMENTS

| | | | |
|---|---|---|---|
| 4,400,948 | 8/1983 | Moorehead | 62/3 |
| 4,718,249 | 1/1988 | Hanson | 62/263 |
| 4,825,667 | 5/1989 | Benedict et al. | 62/51.2 |

FOREIGN PATENT DOCUMENTS

| | | |
|---|---|---|
| 20271704 | 6/1988 | European Pat. Off. . |
| 3541645A1 | 6/1987 | Fed. Rep. of Germany . |
| 2199399 | 12/1987 | United Kingdom . |

OTHER PUBLICATIONS

Article entitled "Bemessen und Aufbau von Peltieragraten" by Dr. H. Müller, Siemens-Electrogeräte AG, in Kältetechnik 15th year, (5) 1963.

*Primary Examiner*—Ronald C. Capossela
*Attorney, Agent, or Firm*—Lee, Mann, Smith, McWilliams & Sweeney

[57] ABSTRACT

A cooling apparatus utilizing the Joule-Thomson effect contains a lead conduit including an inlet end connectable to a source of pressurized gas, and an outlet end, a relief nozzle provided at the outlet end of the lead conduit whereby pressurized gas inflowing through the lead conduit is depressurized at the relief nozzle with cooling, a return for the cooled and depressurized gas, and a countercurrent heat exchanger by which the pressurized gas inflowing through the lead conduit is in heat conductive contact with the cooled and depressurized gas outflowing through the return. Peltier elements serve for additional cooling of the inlet end of the lead conduit and have cold sides which are in immediate contact with the inlet end of the lead conduit. A heat exchanger is provided at the warm sides of the Peltier elements and is throughflown by the gas from the return.

6 Claims, 2 Drawing Sheets

COOLING APPARATUS UTILIZING THE JOULE-THOMSON EFFECT

BACKGROUND OF THE INVENTION

The invention relates to a cooling apparatus utilizing the Joule-Thomson effect and containing (a) a lead conduit having an inlet end connectable to a source of pressurized gas, and an outlet end, (b) a relief nozzle provided at the outlet end of the lead conduit whereby pressurized gas inflowing through the lead conduit, is depressurized with cooling at the relief nozzle, (c) a return for the cooled and depressurized gas, (d) a countercurrent heat exchanger by means of which the pressurized gas inflowing through the lead conduit is in heat conductive contact with the cooled and depressurized gas outflowing through the return, and (e) Peltier elements each having a warm side and a cold side connected to the inlet end of the lead conduit for additional cooling of the inlet end of the lead conduit.

German Published Patent Application No. 3,642,683 describes a cryostat which is based on the Joule-Thomson effect, for cooling an infrared detector. In this cryostat a countercurrent heat exchanger containing a lead conduit is seated in a Dewar vessel. The lead conduit terminates in a relief nozzle. The infrared detector is seated at the end face of the internal wall of the Dewar vessel. A heat insulating layer is disposed intermediate the Dewar vessel and a base for reducing the heat load. For improving the cooling effect achievable by the Joule-Thomson process in a given mass flow of pressurized gas, an inlet end of the lead conduit is cooled by means of Peltier elements.

In the cryostat according to German Published Patent Application No. 3,642,683 the inlet end of the lead conduit is mounted at a carrier made of well heat conducting material and is in good heat conductive contact therewith. The carrier is retained at a heat dissipating base by means of Peltier elements. In this arrangement the cold sides of the Peltier elements are in contact with the carrier and the warm sides of the Peltier elements are in contact with the base.

While it is generally known to cool the warm sides of Peltier elements by heat exchanging means, it has not become known to make use of such construction in combination with Joule-Thomson coolers.

Thus, for axample, a publication by H. Müeller entitled "Design and Set-up of Peltier apparatus" in the Journal "Kältetechnik" Vol. 15, No. 5, pages 137 to 145, 1963, is concerned with the general construction of Peltier elements. As illustrated therein in FIG. 8, and for similar arrangements in FIGS. 11 and 12, the heat is removed by means of an evaporator; the vaporized liquid is recondensed in a heat exchanger and flows back into the evaporator. A liquefier is seated on the cold side at the Peltier elements. This arrangement does not contain a heat exchanger which is immediately connected with the warm sides of the Peltier elements. Also, there is not present a Joule-Thomson cooler and the warm sides of the Peltier elements are not in heat exchange with the depressurized and cooled gas of the Joule-Thomson cooler. In the FIG. 13 arrangement, cooling of the warm sides of the Peltier elements is effected by cooling water.

A cooling and heating device containing a heat pump is described in U.S. Pat. No. 4,718,249. According to FIG. 1*c* thereof, a "thermoelectric module" may serve as such heat pump. Also in this arrangement the cold sides and the warm sides of the Peltier elements which constitute the thermoelectric module, are connected to respective circuits through which a heat transfer fluid is circulated and which contain respective heat exchangers.

In an air drier according to U.S. Pat. No. 4,400,948, air is passed through a heat exchanger which is connected with the cold sides of a "thermo-electric module". The warm sides of Peltier elements thereof are cooled using an air stream which is sucked in by means of a ventilator.

In an apparatus according to German Published Patent Application No. 3,541,645, Peltier elements are employed for recovering water from air. The warm sides of the Peltier elements contain heat exchangers exposed to external air, see FIG. 4, part 26.

A cooling box according to European Published Patent Application No. 0,271,704 also operates using Peltier elements. The goods to be cooled are cooled by means of an air stream which is in contact with the cold side of Peltier elements through a heat exchanger. The heat is removed from the warm sides of the Peltier elements by means of a circulating cooling agent which, in turn, transfers heat to the surrounding air by means of a heat exchanger.

While it is known from the aforementioned prior art to remove heat from the warm sides of Peltier elements by using various means for generating forced cooling, such heat removal is not effected in connection with a Joule-Thomson cooler. Also the initially discussed German Published patent application simply teaches contacting the base and the warm sides of the Peltier elements. The aforenoted printed publications thus do not suggest or indicate that the efficiency of the Joule-Thomson cooler is significantly or superproportionately improved by the inventive measures as will be explained further hereinbelow.

SUMMARY OF THE INVENTION

It is one object to be achieved by the invention to improve, in a cooling apparatus of the initially defined type, the heat removal from the Peltier elements and to either accomplish higher precooling of the inlet end of the lead conduit at a given power consumption of the Peltier elements or reduce the power requirements of the Peltier elements.

According to the invention, this object is achieved in that (f) heat exchanger means are provided at the warm sides of the Peltier elements and are throughflown by the gas outflowing from the return.

The warm sides of the Peltier elements thus are not connected to a base dissipating the heat by heat conduction but to heat exchanger means which are throughflown by the gas from the return. This gas is, upon effluxing from the return, still sufficiently cold for lowering the temperature of the warm side of the Peltier elements to a temperature lower than that of the base and thus for correspondingly reducing the temperature of the cold side of the Peltier elements. During throughpassage through the heat exchanger means, the gas originating from the return is heated so that there also rises the temperature of the warm sides of the Peltier elements towards the outlet side of the heat exchanger means. However, the temperature profile on the cold sides of the Peltier elements is altigether lowered and correspondingly also the temperature profile of the pressurized gas as it passes through the inlet end of the lead conduit. At a given power consumption of the Peltier elements, there can thus be achieved in this manner, as will be explained in detail hereinbelow, a higher precooling of the pressurized gas at the inlet end of the lead conduit or the power consumption can be correspondingly reduced.

The gas dissipates the heat of the Peltier elements by convection so that the environment of the cooling apparatus is not loaded by this heat.

BRIEF DESCRIPTION OF THE DRAWINGS

An exemplary embodiment of the invention will be explained hereinbelow in more detail with reference to the drawings.

DETAILED DESCRIPTION OF THE PREFERRED EMBODIMENTS

Figure 3:
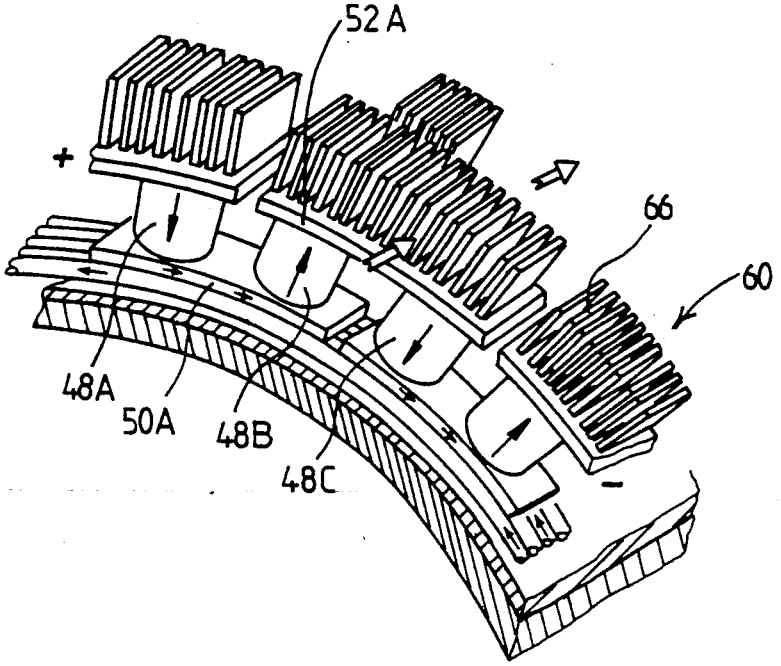
FIG. 3 is a broken illustration in perspective of a ring of Peltier elements and the associated heat exchanger means as used in the cooling apparatus shown in FIG. 2.
Figure 1:
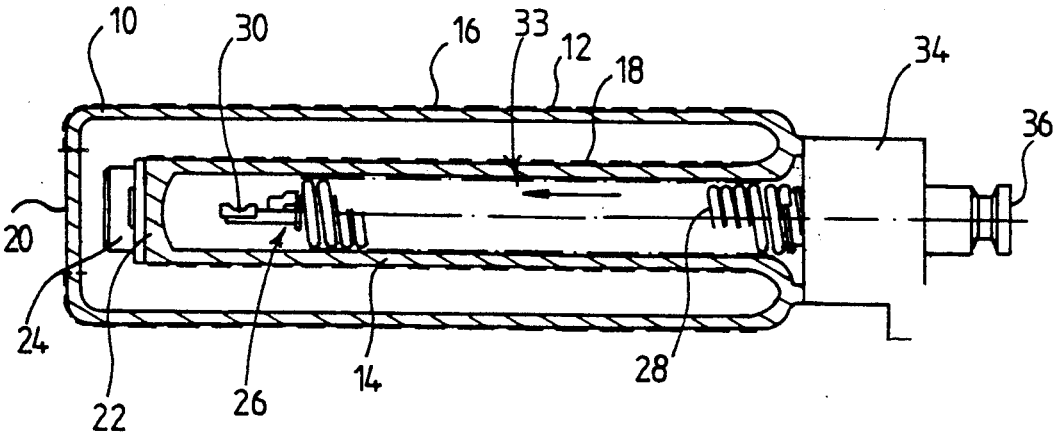
FIG. 1 is a schematic illustration of an exemplary embodiment of the inventive cooling apparatus for cooling an infrared detector.

A Dewar vessel is designated by reference character 10. The Dewar vessel contains two cup-shaped wall portions 12 and 14 which are coaxially arranged inside each other and interconnected at their rim portions. The wall portions 12 and 14 are provided with respective reflective coatings 16 and 18 at their outer surfaces. The space between the wall portions 12 and 14 is evacuated. An end face 20 of the external wall portion 16 does not have a reflective coating and forms a window which is transparent for infrared radiation. An infrared detector 24 is seated at an end face 22 of the internal wall portion 14 within the indermediate space between the wall portions 12 and 14. The infrared detector 24 is cooled by means of a cooling apparatus 26 operating on the basis of the Joule-Thomson effect. This cooling apparatus 26 is seated within the cup-shaped internal wall portion 14.

The cooling apparatus 26 contains a lead or infeed conduit 28 which terminates in a relief or pressure relief nozzle 30. The lead or infeed conduit 28 is coiled within the internal wall portion 14 and provided with a multitude of heat exchanging ribs 32 as will be evident from FIG. 2.

A pressurized gas which originates from a not particularly illustrated source of pressurized gas, is fed into the lead conduit 28. This pressurized gas is depressurized at the relief nozzle 30 and is cooled thereby. The depressurized and cooled gas then flows back via a return or return flow path which, in the illustrated exemplary embodiment, is defined by the external wall portion 14 of the Dewar vessel 10. During its passage through the return or return flow path, the gas is subject to heat exchange with the pressurized gas flowing through the lead or infeed conduit 28 via the heat exchanging ribs 32. This pressurized gas is thereby precooled. Due to the pressure relief, the precooled pressurized gas is further cooled and, in turn, causes further precooling. The internal wall portion 14 and the coiled lead or infeed conduit 28 with its ribs 32 conjointly define a countercurrent heat exchanger which is generally designated by the reference character 33. In this manner there can be obtained very low temperatures. The infrared detector 24 is cooled down to these temperatures.

The Dewar vessel 10 is seated at a flange member 34. The flange member 34 is universally supported conjointly with a seeker which contains the infrared detector 24, relative to a structure like, for example, a missile which is equipped with the seeker. Thus the seeker conjointly with the infrared detector 24 can be aimed at a target. The flange member 34 and thereby the cooling apparatus in its entirety may also be supported at support means for movably or universally supporting the cooling apparatus relative to pressurized gas connector means which are connected to the aforementioned source of pressurized gas. In such construction, flange member 34 constitutes a movable or movably supported member at which a carrier or support 42 is mounted inclusive of the inlet end 40 of the lead or infeed conduit 28. The pressurized gas is supplied by means of a flexible connecting line or conduit 36 which interconnects the aforementioned pressurized gas connector means and the cooling apparatus.

Figure 2:
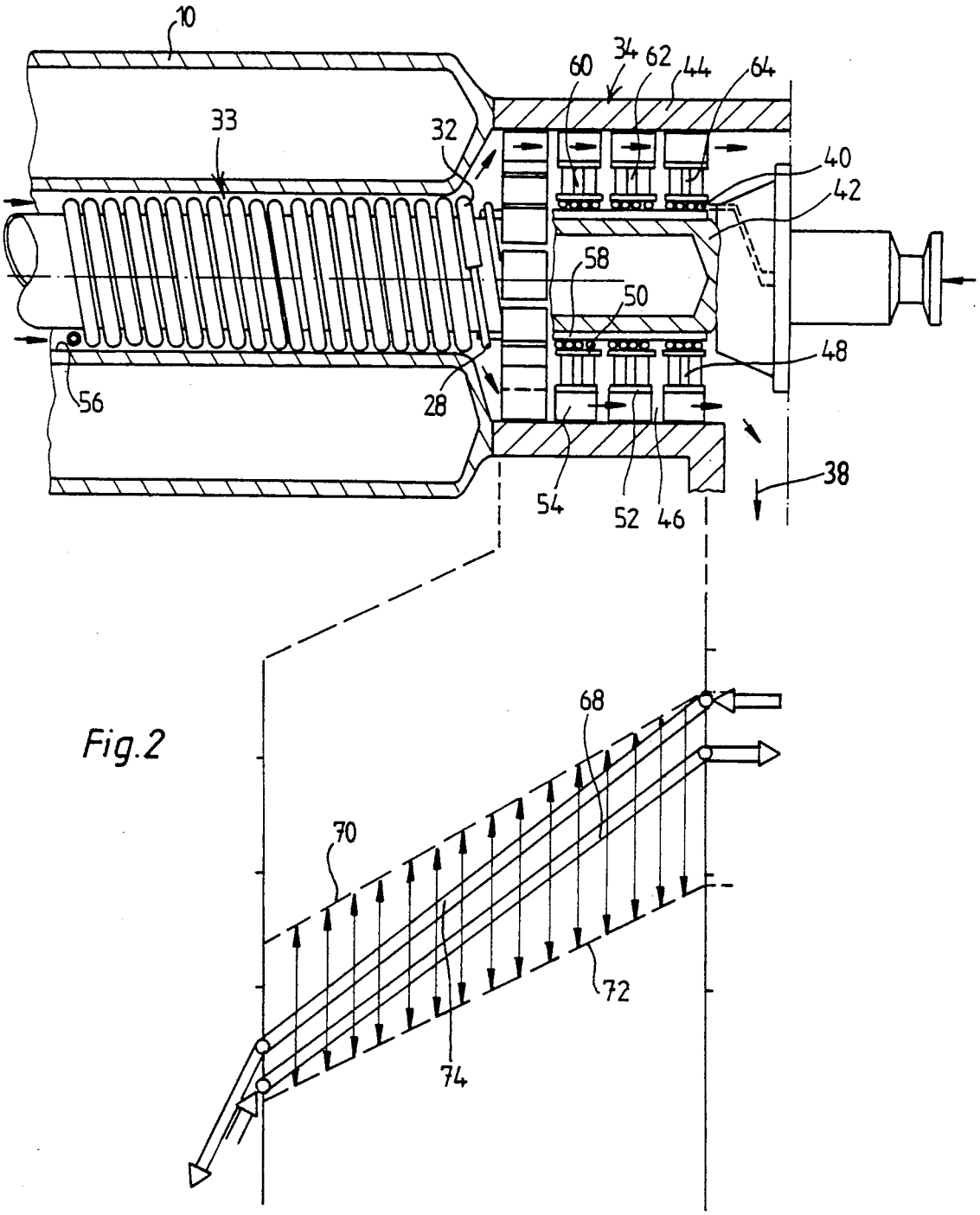
FIG. 2 shows a longitudinal section through the rear part of the cooling apparatus, i.e. the part wich is remote from the infrared detector and the relief nozzle, inclusive of the inlet end of the lead conduit and which inlet end is cooled by the Peltier elements.

As evident from FIG. 2, the flange member 34 contains an outlet 38 for the depressurized gas effluxing from the return flow path.

It is explained in German Published patent application No. 3,642,683 discussed hereinabove that the cooling power of a Joule-Thomson cooler can be substantially improved if the inlet end of the lead or infeed conduit is cooled by means of Peltier elements.

In the inventive cooling apparatus, an inlet end 40 of the lead or infeed conduit 28 is helically wound upon the substantially cylindrical carrier or support 42 defines an substantially cylindrical carrier or support 42 defines an annular space 46 conjointly with a shell member 44 which is substantially concentrically disposed relative to the substantially cylindrical carrier or support 42. Peltier elements 48 are substantially radially arranged within the annular space 46. Cold sides 50 thereof are connected with the inlet end 40 of the lead or infeed conduit 28 and warm sides 52 thereof are connected with heat exchanger means 54 which protrude into the annular space 46. The depressurized gas effluxing from the return or return flow path, i.e. from an interior space 56 bounded by the internal wall portion 14 of the Dewar vessel 10, is passed through the annular space 14 and flows around and past the heat exchanger means 54.

The cold sides 50 of the Peltier elements 48 are in immediate contact with the inlet end 40 of the lead or infeed conduit 28. An insulating layer 58 is applied intermediate the inlet end 40 of the lead conduit 28 and the carrier or support 42. As will be apparent from FIGS. 2 and 3, the Peltier elements 48 are arranged in a number of meander-shaped rings 60, 62 and 64 in which the Peltier elements are electrically series connected. Each two adjacent Peltier element legs 48A and 48B of, for example, the ring 60 are electrically connected on their respective cold sides with a common plate 50A of annular sectional shape. This plate 50A is in heat conductive but electrically insulating contact with the inlet end 40 of the lead conduit 28. The Peltier element leg 48B of the aforementioned pair of adjacent Peltier elements legs 48A and 48B conjointly with the next-following Peltier element leg 48C of the ring 60 is connected to the warm side by means of a conductive plate 52A of annular sectional shape. The heat exchanger means 54 are seated at the plate 52A. The heat exchanger means 54 are formed by substantially radial aluminum ribs 66. The depressurized gas which effluxes via the return or return flow path of the inventive Joule-Thomson cooling apparatus, exists then between the aluminum ribs 66.

The various rings 60, 62 and 64 are series arranged in axial direction. The individual rings 60, 62 and 64 are thermally decoupled from each other. In the illustrated exemplary embodiment, the first ring 60 is most strongly cooled on its warm side by the gas effluxing from the return flow path. The gas already thereby is heated to some extent. Therefore, the warm side of the second ring 62 is cooled to a lesser extent and stays at a higher temperature. The warm side of the third ring 64 is subject to still less cooling by the still further heated gas. However, the thermal decoupling of the rings 60, 62 and 64 provides for optimum efficiency of each one of the rings 60, 62 and 64.

The mode of action of the aforedescribed arrangement will be evident from the diagram shown in the lower part of FIG. 2.

Therein, reference character 68 designates the temperature profile of the gas effluxing from the return or return flow path of the Joule-Thomson cooler 26 during passage through the heat axchanger means 54. The gas is heated as the result of heat exchange with the warm sides 52 of the Peltier elements 48. The warm sides 52 of the Peltier elements 48 are cooled. During such heat exchange the Peltier elements located adjacent the return or return flow path are more strongly cooled than those on the outlet side. The temperature of the warm sides 52 of the Peltier elements 48 in the three ring 60, 62 and 64 thus can be illustrated in a simplified manner by a downwardly inclined line 70 which descends from the right to the left in FIG. 2. The left end of the line 70 therein corresponds to the warm side of the Peltier elements in the ring 60. The right end of the line 70 corresponds to the warm side of the Peltier elements in the ring 64. The cold sides 50 of the Peltier elements 48 are colder by the temperature difference which is generated by the Peltier elements 48. The temperature of these cold sides 50 can be represented in a simplified manner by the line 72. By means of these cold sides 50 of the Peltier elements 48, the pressurized gas is cooled in the inlet end 40 of the lead or infeed conduit 28. The temperature of the pressurized gas is thereby changed along its flow path through the inlet end 40 in accordance with the line 74. This line 74 extends from the environmental temperature which approximately corresponds to the temperature of the warm sides of the Peltier elements 48 on the right-hand side of FIG. 2, to a point which is located above the line 72 by a predetermined amount on the left-hand side of FIG. 2. This amount corresponds to the temperature difference required for the heat transmission. It will be recognized thgat the extent of cooling of the pressurized gas which is accomplished in this manner, is substantially greater than the temperature difference which exists at the Peltier elements.

The aforedescribed arrangement offers a number of advantages: There is achieved a greater extent of precooling for the pressurized gas at the inlet end 40 of the lead or infeed conduit 28 as compared to the precooling which can be obtained solely due to the temperature difference existing at the Peltier elements 48. This permits reducing the electric power which is supplied to the Peltier elements 48. The Peltier elements 48 are immediately connected to the inlet end 40 of the lead or infeed conduit 28. This inlet end 40 is separated from the carrier or support 42 by means of the insulating layer 58. Therefore, and in practice, only the inlet end 40 inclusive of the pressurized gas flowing therethrough, require to be cooled and not the entire carrier or support 42. Also thereby the cooling power is reduced which is required for the Peltier elements 48.

The heat is removed by means of the effluxing gas. Therefore, there does not exist any problem regarding heat removal from the environment of the inventive cooling apparatus. This is of particular significance in the event that the cooling apparatus, as in the illustrated exemplary embodiment, conjointly with the associated seeker is universally supported and movable toward a target and the pressurized gas supply is effected through a length of flexible conduit. When in such construction the precooling is effected at the non-movable members, i.e. upstream of the length of flexible conduit, then, the precooled pressurized gas is re-heated in the length of flexible conduit which acts like a heat exchanger. However, the heat can be removed from the movable seeker either not at all or only with difficulty.

Instead of the aluminum ribs 66, an air-permeable aluminum wire mesh may also be provided as the heat exchanger means 54.

While there are shown and described present preferred embodiments of the invention, it is to be distinctly understood that the invention is not limited thereto, but may be otherwise variously embodied and practiced within the scope of the following claims.

What I claim is:

1. A cooling apparatus utilizing the Joule-Thomson effect, comprising:

a lead conduit having an inlet end and an outlet end;

said inlet end containing connecting means for connection to a source of pressurized gas;

a pressure relief nozzle provided at said outlet end of said lead conduit and causing the pressurized gas which flows from said inlet end through said lead conduit, to be cooled upon depressurization at the pressure relief nozzle;

a return flow path for the cooled and depressurized gas;

a countercurrent heat exchanger providing heat exchange between the pressurized gas which is infed through said lead conduit, and the cooled and depressurized gas which flows out along said return flow path;

a predetermined number of Peltier elements;

each one of said Peltier elements having a warm side and a cold side;

said cold side of said Peltier elements being connected with the inlet end of said lead conduit for cooling said inlet end of said lead conduit;

heat exchanger means connected with the warm side of said Peltier elements; and said heat exchanger means being arranged in a flow of depressurized gas effluxing from said return flow path.

2. The cooling apparatus as defined in claim 1, wherein:

said cold side of said Peltier elements is arranged in immediate contact with the inlet end of said lead conduit.

3. The apparatus as defined in claim 2, further including:

a substantially cylindrical carrier;

said inlet end of said lead conduit being helically wound upon said substantially cylindrical carrier;

a shell member arranged substantially concentrical relative to said substantially cylindrical carrier;

said substantially cylindrical carrier and said shell member conjointly defining an annular space;

said Peltier elements being substantially radially disposed in said annular space;

said heat exchanger means protruding into said annular space from said warm side of said Peltier elements; and said flow of depressurized gas effluxing from said return flow path, passing through said annular space and flowing around and past said heat exchanger means.

4. The cooling apparatus as defined in claim 3, further including:

an insulating layer interposed between the inlet end of the lead conduit and the substantially cylindrical carrier.

5. The cooling apparatus as defined in claim 3, wherein:

said predetermined number of Peltier elements are arranged in a meander-shaped plurality of rings defining an axial direction;

said predetermined number of Peltier elements being electrically series connected;

said rings of said meander-shaped plurality of rings being series arranged in said axial direction; and the individual rings of said meander-shaped plurality of rings being thermally decoupled from each other.

6. The cooling apparatus as defined in claim 3, further including:

a pressurized gas connector means connected to said source of pressurized gas;

support means for movably supporting the cooling apparatus relative to said pressurized gas connector means;

a length of flexible conduit interconnecting the cooling apparatus and said pressurized gas connector means; and said substantially cylindrical carrier conjointly with the inlet end of said lead conduit and said Peltier elements being mounted at said support means movably supporting the cooling apparatus.

* * * * *